US009567150B2

(12) United States Patent
Lachance

(10) Patent No.: US 9,567,150 B2
(45) Date of Patent: Feb. 14, 2017

(54) REFRIGERATING ASSEMBLY

(71) Applicant: 9201947 Canada Inc., Laval (CA)

(72) Inventor: Yves Lachance, Laval (CA)

(73) Assignee: 9201947 Canada Inc., Laval (CA)

( * ) Notice: Subject to any disclaimer, the term of this patent is extended or adjusted under 35 U.S.C. 154(b) by 0 days.

(21) Appl. No.: 14/456,368

(22) Filed: Aug. 11, 2014

(65) Prior Publication Data

US 2014/0345315 A1 Nov. 27, 2014

Related U.S. Application Data

(62) Division of application No. 13/382,014, filed as application No. PCT/CA2010/001067 on Jul. 2, 2010, now Pat. No. 8,800,806.

(Continued)

(51) Int. Cl.

| | |
|---|---|
| ***B65D 81/38*** | (2006.01) |
| ***F25D 3/08*** | (2006.01) |
| ***F25D 31/00*** | (2006.01) |

(52) U.S. Cl.

CPC ..... *B65D 81/38* (2013.01); *B65D 81/382* (2013.01); *B65D 81/3825* (2013.01); *F25D 3/08* (2013.01);

(Continued)

(58) Field of Classification Search

CPC ... B65D 81/38; B65D 81/382; B65D 81/3825; F25D 31/00; F25D 3/08; F25D 2331/812; F25D 2303/0831; F25D 2303/08821

(Continued)

(56) References Cited

U.S. PATENT DOCUMENTS 2,039,736 A * 5/1936 Munters ..... A23G 9/08 62/430
2,526,165 A * 10/1950 Smith ..... A47G 19/027 126/261

(Continued)

FOREIGN PATENT DOCUMENTS

WO WO-2009028914 A2 3/2009

OTHER PUBLICATIONS

International Search Report for corresponding PCT Application No. PCT/CA2010/001067, mailed Oct. 27, 2010.

(Continued)

*Primary Examiner* — Robert J Hicks
*Assistant Examiner* — Kareen Thomas
(74) *Attorney, Agent, or Firm* — Mintz Levin Cohn Ferris Glovsky and Popeo, P.C.; Steven M. Jensen

(57) ABSTRACT

There is provided a refrigerating assembly for temporarily storing an item at a first temperature lower than an ambient temperature. The refrigerating assembly comprises a container for receiving the item and a shell adapted for removably receiving the container therein. The container comprises a sidewall having therein defined a cavity containing an amount of a refrigerant medium having a second temperature lower than the ambient temperature for temporarily maintaining the item received in the container at the first temperature. The shell has an outer surface which is at the ambient temperature and an inner surface which has a layer of thermally insulating material mounted thereon for thermally insulating the shell from the container, thereby maintaining the outer surface at the ambient temperature. There is further provided a method for temporarily storing an item at a first temperature lower than an ambient temperature.

10 Claims, 11 Drawing Sheets

Related U.S. Application Data

(60) Provisional application No. 61/222,978, filed on Jul. 3, 2009.

(52) U.S. Cl.
CPC ..... *F25D 31/00* (2013.01); *F25D 2303/0831* (2013.01); *F25D 2303/08221* (2013.01); *F25D 2331/812* (2013.01)

(58) Field of Classification Search
USPC ..... 220/23.83, 23.86, 23.87, 23.89, 23.9, 220/592.01–592.28
See application file for complete search history.

(56) References Cited

U.S. PATENT DOCUMENTS 2,685,318 A * 8/1954 Merkle ..... B65D 81/3886 215/395
2,838,916 A * 6/1958 Planes Y Sola ..... F25D 31/008 62/336
2,926,508 A * 3/1960 Moon ..... A47G 19/2288 165/47
3,161,031 A * 12/1964 Flannery ..... F25D 3/08 215/395
3,205,677 A * 9/1965 Stoner ..... A47G 19/2288 206/519
3,205,678 A * 9/1965 Stoner ..... A47G 19/127 220/23.87
3,269,144 A * 8/1966 Poris ..... F25D 3/00 62/457.3
3,302,428 A * 2/1967 Paquin ..... B65D 81/3883 220/903
3,360,957 A * 1/1968 Paquin ..... A47G 19/2288 62/457.3
3,766,975 A 10/1973 Todd
4,005,586 A 2/1977 Lyons
4,151,923 A * 5/1979 Bernardi ..... A47G 19/2288 215/12.1
4,163,374 A 8/1979 Moore et al.
4,688,398 A 8/1987 Baek
4,741,176 A * 5/1988 Johnson ..... B65D 75/42 62/457.4
4,798,063 A * 1/1989 Rimmer ..... B65D 81/3886 62/371
4,889,302 A * 12/1989 Tucker ..... A47G 23/0216 215/12.2
4,981,234 A * 1/1991 Slaughter ..... 62/457.1
5,088,301 A 2/1992 Piepenbrink
5,231,850 A 8/1993 Morris
5,271,244 A * 12/1993 Staggs ..... A47G 19/2288 62/457.3
5,345,784 A 9/1994 Bazemore et al.
5,361,604 A 11/1994 Pier et al.
5,403,095 A * 4/1995 Melk ..... A45C 11/20 220/23.87
5,406,808 A * 4/1995 Babb ..... A47J 41/0005 220/379
5,597,086 A * 1/1997 King-Shui ..... A47J 41/02 220/23.87
5,970,737 A 10/1999 Downey
6,050,443 A 4/2000 Tung
6,161,720 A 12/2000 Castle
6,244,065 B1 6/2001 Wuestman
6,634,417 B1 * 10/2003 Kolowich ..... A47G 19/127 165/10
6,668,579 B1 12/2003 Bigwood et al.
6,789,393 B2 * 9/2004 Dais et al. ..... 62/457.6
6,913,165 B2 * 7/2005 Linz ..... A47J 43/27 220/568
6,948,334 B1 * 9/2005 Challenger ..... A47G 19/027 220/252
6,968,888 B2 * 11/2005 Kolowich ..... A47G 19/127 165/10
7,290,677 B2 11/2007 Wuestman
7,427,001 B1 9/2008 Keitges
7,431,174 B2 10/2008 Thissen
7,571,830 B2 * 8/2009 Lin ..... A47J 43/27 206/217
8,561,825 B1 * 10/2013 Kino ..... A47J 41/0077 215/13.1
8,800,806 B2 8/2014 Lachance
2007/0144205 A1 6/2007 Moore
2007/0180850 A1 8/2007 Thompson
2012/0118897 A1 5/2012 Davis

OTHER PUBLICATIONS

International Preliminary Report on Patentabilityfor corresponding PCT Application No. PCT/CA2010/001067, dated Oct. 31, 2011.

* cited by examiner

REFRIGERATING ASSEMBLY

CROSS REFERENCE TO RELATED APPLICATIONS

The present application is a divisional application of U.S. patent application Ser. No. 13/382,014, filed Jan. 3, 2012, allowed, which is the U.S. National Stage of PCT Patent Application No. PCT/CA2010/001067, filed Jul. 2, 2010, which claims priority from U.S. Provisional Patent Application Ser. No. 61/222,978 filed Jul. 3, 2009. The entire teachings of each of the foregoing applications are herein incorporated by reference.

TECHNICAL FIELD

The invention relates to refrigerating assemblies. More precisely, this invention pertains to a refrigerating assembly for temporarily storing an item at a temperature below an ambient temperature.

BACKGROUND

Refrigeration has many uses, from keeping food at a temperature safe for consumption to maintaining organisms such as bacteria in a living state.

Domestic refrigeration is commonly achieved by using a domestic refrigerator. However, such refrigerators generally need an energy source and are therefore cumbersome and not easily portable.

Prior attempts have been made to refrigerate an item using a container having a cavity containing an amount of a refrigerant liquid. The container is first placed in a cold environment, which lowers the temperature of the refrigerant liquid. The container may then be placed in an environment which is at an ambient temperature, the container thereby keeping an item placed in the container at a temperature lower than the ambient temperature.

Unfortunately, when such container is placed in an environment containing an amount of humidity, condensation tends to form on the exterior of the container, as one skilled in the art will appreciate. Such condensation may wet other items such as a bag in which the container is placed or articles placed in the bag alongside the container, which is highly undesirable.

Condensation may further detract from the aesthetic appearance of the container by partially or completely hiding logos or other graphics printed or inscribed on the exterior of the container.

There is therefore a need for a refrigerating assembly that will overcome at least one of the above-identified drawbacks.

Features of the invention will be apparent from review of the disclosure, drawings and description of the invention below.

BRIEF SUMMARY

According to one aspect, there is provided a refrigerating assembly for temporarily storing an item at a first temperature lower than an ambient temperature.

The refrigerating assembly comprises a container comprising a container sidewall having a container inner surface for receiving the item thereon and a container outer surface, the container sidewall further having therein defined a cavity containing an amount of a refrigerant medium having a second temperature lower than the ambient temperature, the cavity being in thermal connection with the container inner surface for temporarily maintaining the item at the first temperature when the item is received on the container inner surface; and a shell adapted for removably receiving the container therein, the shell comprising a shell sidewall having a shell inner surface and a shell outer surface, the shell outer surface being at the ambient temperature, the shell inner surface having a layer of thermally insulating material mounted thereon for thermally insulating the shell from the container when the container is removably received in the shell, thereby maintaining the shell outer surface at the ambient temperature when the container is received in the shell.

In one embodiment, the shell is adapted to cover at least part of the container outer surface when the container is received in the shell.

In another embodiment, the refrigerant assembly further comprises attachment means for removably attaching the container to the shell when the container is received in the shell.

In yet another embodiment, the container sidewall comprises a closed end and an open end defining an opening for selectively placing the item in the container and removing the item from the container, the open end having a peripheral edge defining a rim of the container.

In a further embodiment, the shell sidewall comprises a closed end and an open end defining an opening for selectively placing the container in the shell and removing the container from the shell, the open end having a peripheral edge defining a rim of the shell.

In yet a further embodiment, the refrigerant assembly further comprises attachment means for removably attaching the container to the shell when the container is received in the shell.

In one embodiment, the attachment means comprise a first peripheral flange extending inwardly from the rim of the container; an opposed second peripheral flange extending outwardly from the rim of the shell; and a fastening element for removably engaging the first and second peripheral flanges to thereby removably attach the container to the shell.

In a further embodiment, the fastening element comprises a fastening ring having an annular channel defined therein, the annular channel comprising a first channel portion sized and shaped to receive the first peripheral flange and a second channel portion sized and shaped to receive the second peripheral flange.

In yet a further embodiment, the fastening ring is manufactured from a resilient material for engaging the first and second peripheral flanges in snap engagement.

In another embodiment, each of the first and second peripheral flanges has a square cross-section and each of the first and second channel portions has a corresponding square cross-section.

In yet another embodiment, each of the first and second peripheral flanges has a semicircular cross-section and each of the first and second channel portions has a corresponding semicircular cross-section.

In one embodiment, the attachment means comprise an annular protrusion and a corresponding annular groove, the annular protrusion and a corresponding annular groove being respectively associated with one of the container and the shell.

In a further embodiment, the annular groove is defined in the shell inner surface, near the rim of the shell, and the corresponding annular flange extends outwardly from the container outer surface, near the rim of the container, for removably engaging the annular groove.

In another embodiment, the annular groove is defined in the container outer surface, near the rim of the container, and the corresponding annular flange extending inwardly from the shell inner surface, near the rim of the shell, for removably engaging the annular groove.

In yet another embodiment, at least one of the container and the shell is manufactured from a resilient material to enable the annular protrusion to engage the corresponding annular groove in a snap engagement when the container is received in the shell.

In one embodiment, the resilient material is a thermoplastic selected from a group consisting of acrylonitrile butadiene styrene and polyvinyl chloride.

In another embodiment, the attachment means comprise a cover adapted to be fastened on the rim of the shell and to abut the rim of the container for preventing the container from exiting the shell through the opening of the shell.

In one embodiment, the container comprises a flat bottom portion for enabling the container to rest on a flat surface while keeping the opening of the container facing upwardly.

In another embodiment, the container sidewall comprises a relief opening defined on one of the container inner surface and the container outer surface for allowing communication between the cavity and the environment such that pressure inside the cavity is maintained equal to an ambient pressure.

In yet another embodiment, the container and the shell are complementary in shape for enabling the container outer surface to rest against the layer of thermally insulating material.

In one embodiment, the refrigerant medium comprises a refrigerant gel.

In another embodiment, the item comprises a perishable food item.

According to another aspect, there is also provided a method for temporarily storing an item at a first temperature lower than an ambient temperature.

The method comprises providing a container comprising a container sidewall having a container inner surface for receiving the item thereon and a container outer surface, the sidewall further having therein defined a cavity in thermal connection with the inner surface, the cavity containing an amount of a refrigerant medium having a second temperature lower than the ambient temperature; placing the item on the container inner surface; providing a shell adapted for removably receiving the container therein, the shell comprising a shell sidewall having a shell inner surface, the shell inner surface having a layer of thermally insulating material mounted thereon and a shell outer surface, the shell outer surface being at the ambient temperature; engaging the container in the shell, the layer of thermally insulating material maintaining the shell outer surface at the ambient temperature and thereby preventing condensation from forming thereon.

In one embodiment, the method further comprises, before providing the container, at least partially filling the cavity with the amount of refrigerant medium.

In another embodiment, the method further comprises, before providing the container, refrigerating the container until the refrigerant medium reaches the second temperature.

BRIEF DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION

In the following description of the embodiments, references to the accompanying drawings are by way of illustration of an example by which the invention may be practiced. It will be understood that other embodiments may be made without departing from the scope of the invention disclosed.

Figure 1:
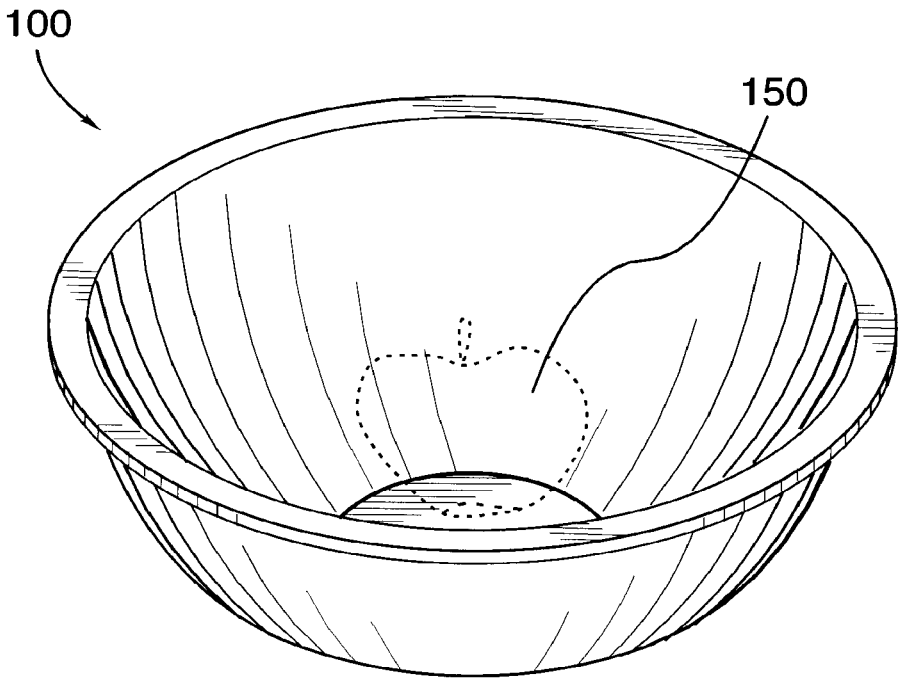
FIG. 1 is a drawing showing a perspective view of a refrigerating assembly, in accordance with one embodiment.
Figure 2:
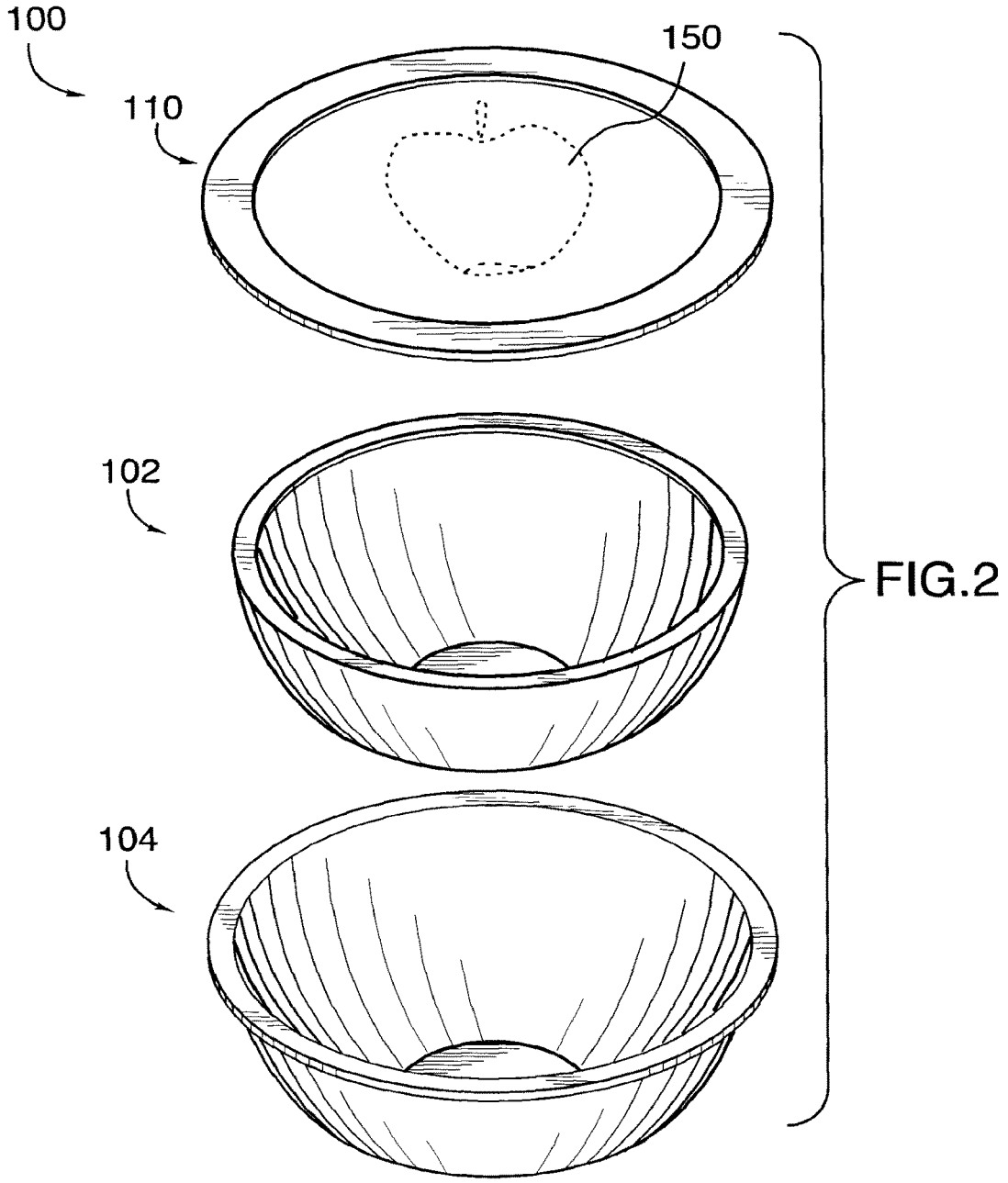
FIG. 2 is a drawing showing an exploded view of the refrigerating assembly shown in FIG. 1.

Referring to FIGS. 1 and 2, there is shown a refrigerating assembly 100, in accordance with one embodiment. The refrigerating assembly 100 is adapted for maintaining an item 150 at a first temperature, or desired storage temperature, lower than an ambient temperature.

The skilled addressee will appreciate that the ambient temperature is the temperature of an environment where the refrigerating assembly 100 is placed. For instance, if the refrigerating assembly 100 is placed in a room containing air and the air is at a given air temperature, then the ambient temperature is the given air temperature.

Still referring to FIGS. 1 and 2, the refrigerating assembly 100 comprises a container 102 for receiving the item 150. The container 102 is adapted to be refrigerated until at least part of the container 102 reaches a second temperature, or refrigerating temperature, lower than the ambient temperature, as it will become apparent below. When the container 102 is at the refrigerating temperature and the item 150 is received in the container 102, the item 150 is temporarily maintained at the desired storage temperature for a given amount of time, as it will become apparent below.

Still referring to FIGS. 1 and 2, the refrigerating assembly 100 further comprises a shell 104 adapted for receiving the container 102 therein. The shell 104 contributes to enhancing the appearance of the refrigerating assembly 100 as well as preventing condensation from forming on the exterior of the refrigerating assembly 100, as it will become apparent below.

In one embodiment, the item 150 is a perishable food item. In such an embodiment, the refrigerating assembly 100 enables the food item to be stored at a desired, cool temperature for a given amount of time such that it may be safely consumed when it is later retrieved from the refrigerating assembly 100.

In an alternative embodiment, the item 150 is a drug product labeled for refrigerated storage, such as insulin for instance. In such an embodiment, the refrigerating assembly 100 enables the drug product to be stored at a temperature recommended by a manufacturer of the drug product, the recommended temperature being lower than the ambient temperature.

In one embodiment, the refrigerating assembly 100 further comprises attachment means 110 for attaching the container 102 to the shell 104 when the container 102 is received in the shell 104, as it will become apparent below. Such a configuration advantageously prevents the container 102 from being undesirably disengaged from the shell 104 by gravity when the refrigerating assembly 100 is inclined, for instance.

Figure 3A:
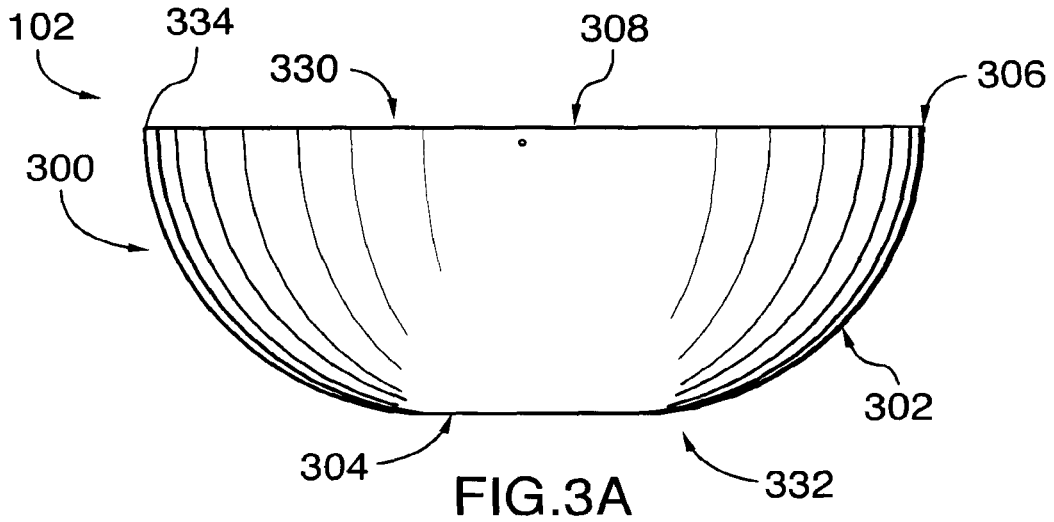
FIG. 3A is a drawing showing a side elevation view of a container for the refrigerating assembly shown in FIG. 1.
Figure 3B:
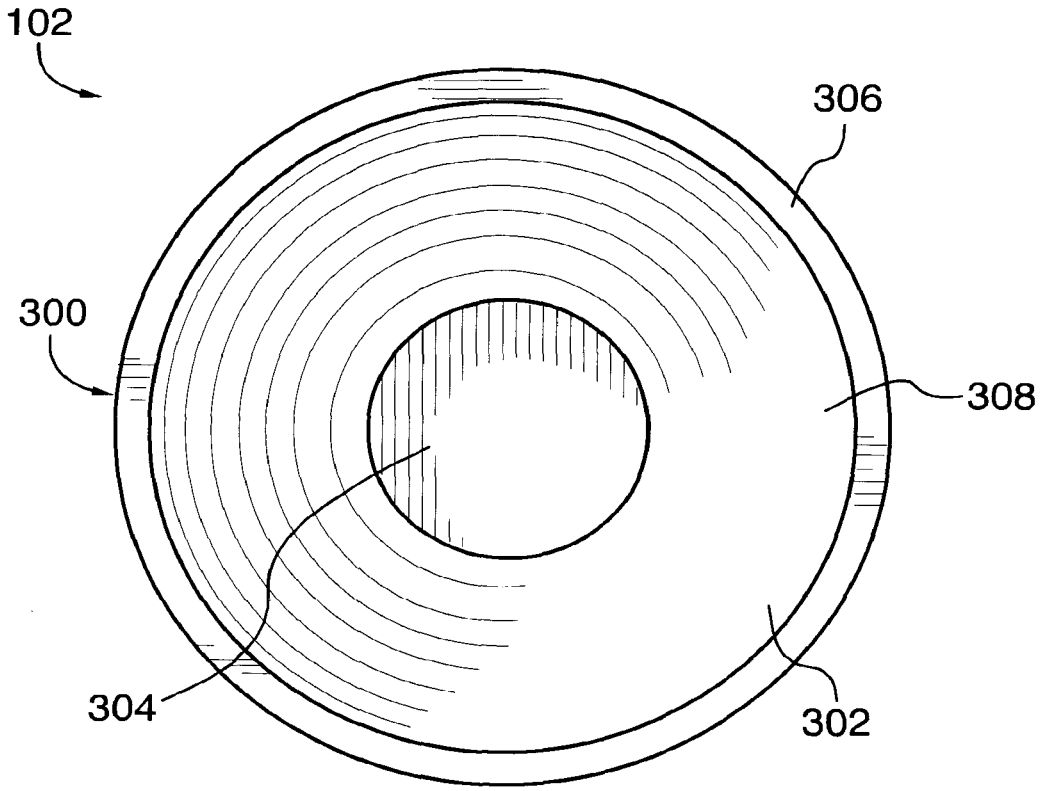
FIG. 3B is a drawing showing a top plan view of the container shown in FIG. 3A.

Now turning to FIGS. 3A and 3B, there is shown the container 102 of the refrigerating assembly 100, in accordance with one embodiment. In the illustrated embodiment, the container 102 has a generally bowl-like configuration and comprises a concave container sidewall 300 having a closed end 330 and an open end 332 defining an opening 308 for selectively placing the item 150 in the container 102 and removing the item 150 from the container 102. More specifically, the container sidewall 300 comprises a central, circular flat bottom portion 304 and a lateral curved portion 302 extending peripherally and upwardly from the flat bottom portion 304 towards a peripheral edge 334 of the opening 308, which defines a circular rim 306 of the container 102.

It will be appreciated that the flat bottom portion 304 is adapted for enabling the container 102 to rest on a flat surface while keeping the opening 308 of the container 102 facing upwardly, thereby keeping the item 150, not shown in FIGS. 3A and 3B, inside the container 102 by gravity. This is particularly advantageous when the item 150 is a liquid substance, for instance milk or water.

Figure 3C:
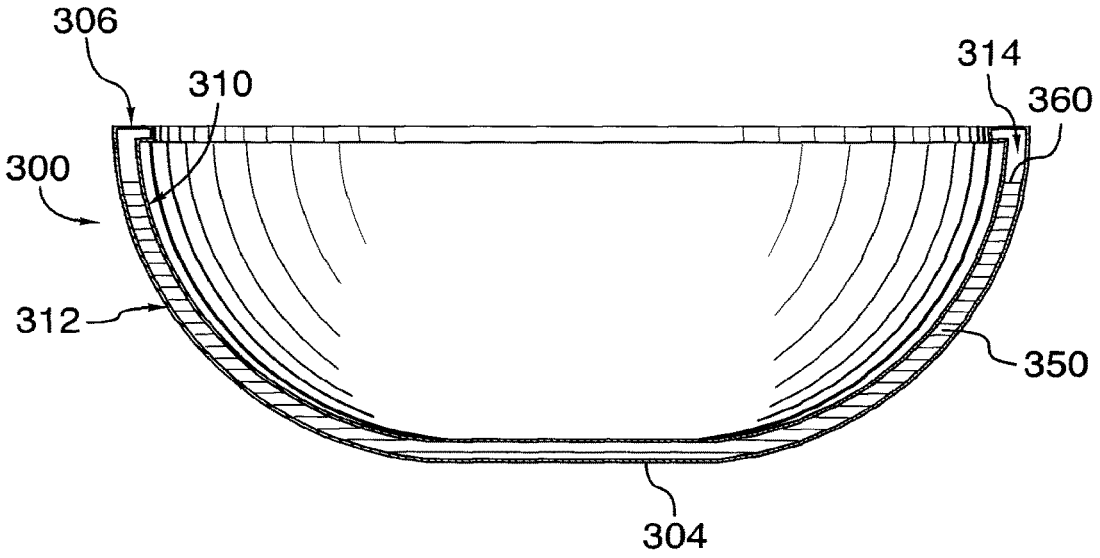
FIG. 3C is a drawing showing a sectional view, taken along line III-III of FIG. 3B, of the container shown in FIG. 3A.

Now turning to FIG. 3C, the hollow sidewall 300 has a container inner surface 310 adapted to receive the item 150, not shown in FIG. 3C, thereon and an opposed container outer surface 312. In the illustrated embodiment, the container inner surface 310 and the container outer surface 312 are spaced apart and closed off to define a cavity 314 therebetween. The cavity 314 contains an amount of a refrigerant medium 350 capable of reaching the refrigerating temperature, as it will become apparent below.

In one embodiment, the refrigerant medium 350 is a known, preferably non-toxic refrigerant fluid such as a refrigerant gel, water or the like.

In the illustrated embodiment, the container 102 is made of a heat conducting material to enable thermal connection between the container inner surface 310 and the cavity 314 and therefore between the container inner surface 310 and the refrigerant medium 350 in the cavity 314, as it will become apparent below.

The skilled addressee will appreciate that the volume of a fluid usually varies when its temperature changes. In one embodiment, when the refrigerant medium 350 is a fluid and the temperature of the fluid changes, pressure inside the cavity 314 is maintained equal to an ambient pressure of the environment by a relief hole, not shown, adapted for allowing communication between the cavity 314 and the environment. The relief hole, not shown, may be provided on the hollow sidewall 300, near the rim 306 of the container 102, such that it remains over a level of refrigerant medium 360 when the bottom portion 304 of the container 102 is resting on a flat surface.

According to one configuration, the container 102 is further provided with a flexible, impermeable annular membrane, not shown, secured in the cavity 314, near the rim 306 of the container 102 for preventing the refrigerant medium 350 from exiting the cavity 314 through the relief hole 316 when the container 102 is inclined, as one skilled in the art will appreciate.

It will be appreciated that the container 102 may have various other configurations known to the skilled addressee and that the configuration disclosed herein is merely provided as an example.

Figure 4A:
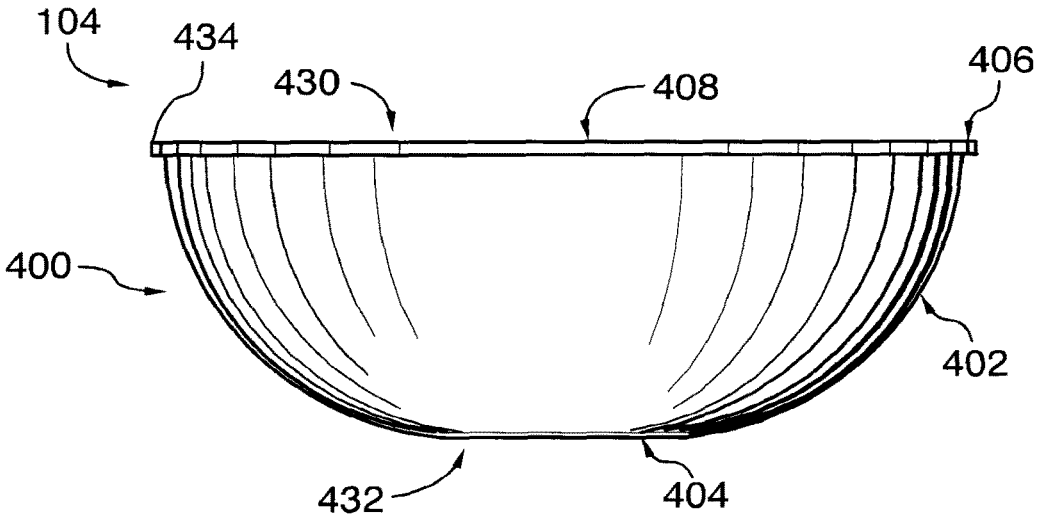
FIG. 4A is a drawing showing a side elevation view of a shell for the refrigerating assembly shown in FIG. 1.
Figure 4B:
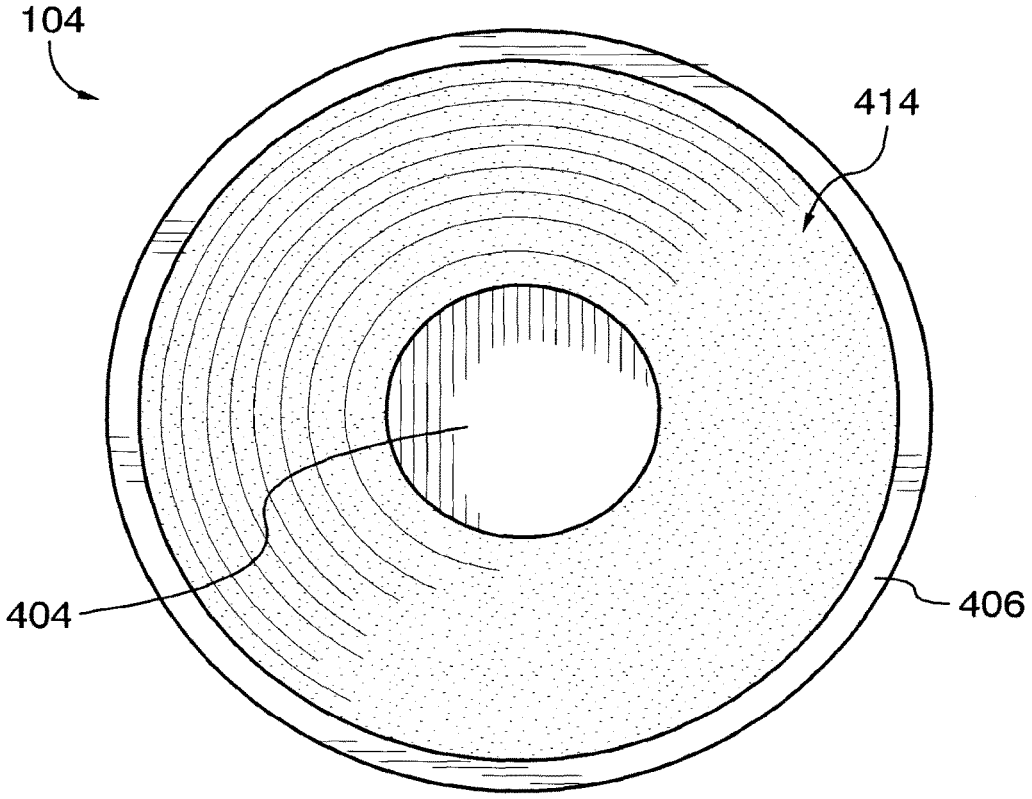
FIG. 4B is a drawing showing a top plan view of the shell shown in FIG. 4A.
Figure 4C:
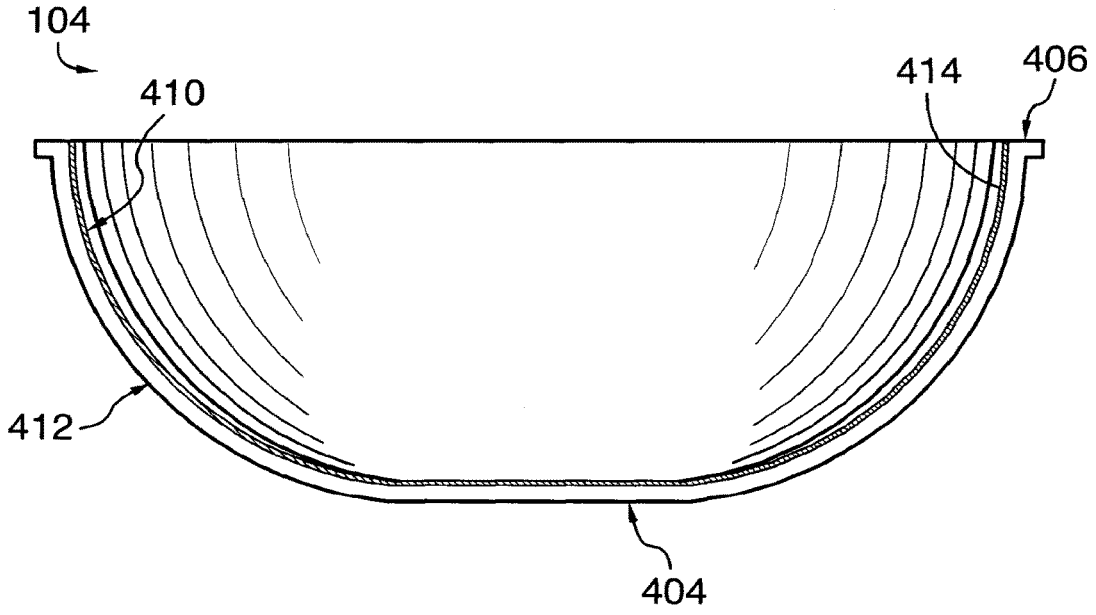
FIG. 4C is a drawing showing a sectional view, taken along line IV-IV of FIG. 4B, of the shell shown in FIG. 4A.

Now turning to FIGS. 4A to 4C, there is shown the shell 104 for the refrigerating assembly 100, in accordance with one embodiment.

Similarly to the container 102, the shell 104 has a generally bowl-like configuration and comprises a concave shell sidewall 400 having a closed end 430 and an open end 432 defining an opening 408 for selectively placing the container 102 in the shell 104 and removing the container 102 from the shell 104. More specifically, the shell sidewall 400 comprises a central, circular flat bottom portion 404 and a lateral curved portion 402 extending peripherally and upwardly from the flat bottom portion 404 towards a peripheral edge 434 of the opening 408, which defines a circular rim 406 of the shell 104.

It will be appreciated that the flat bottom portion 404 is adapted for enabling the shell 104 to rest on a flat surface while the container 102, not shown in FIGS. 4A to 4C, is received in the shell 104. The opening 308 of the container 102 is thereby kept facing upwardly and the item 150, not shown in FIGS. 4A to 4C, is kept inside the container 102 by gravity, as described hereabove.

The skilled addressee will appreciate that the container 102 and the shell 104 are complementary in shape such that the container 102 may be snuggly received in the shell 104. This configuration prevents the container 102 from moving relative to the shell 104 when received therein, thereby advantageously preventing the item 150 from exiting the container 102 to enter the shell 104. This is particularly advantageous when the item 150 is a liquid to prevent the liquid from spilling into the shell 104.

The concave shell sidewall 400 further has a shell inner surface 410 and an opposed shell outer surface 412, as best shown in FIG. 4C.

In one embodiment, the shell 104 is adapted to cover at least part of the container outer surface 312. In such an embodiment, the shell outer surface 412 may be adapted for providing the refrigerating assembly 100 with an aesthetically pleasing appearance. For instance, in one embodiment, the shell outer surface 412 comprises an inscription representing a decorative motive, a commercial logo or any other inscription a manufacturer of the shell 104 may desire. In such an embodiment, the inscription is placed on the shell outer surface 412 using techniques known to the skilled addressee such as printing, engraving or the like.

The shell outer surface 412 is further adapted for handling the refrigerating assembly 100. The skilled addressee will appreciate that if the shell outer surface 412 is at a temperature lower than the ambient temperature, the refrigerant assembly 100 may cause discomfort to a user handling it. Therefore, in the illustrated embodiment, the shell outer surface 412 is maintained at the ambient temperature, thereby advantageously preventing discomfort for the user.

More specifically, the shell inner surface 410 has a layer of thermally insulating material 414 mounted thereon, as best shown in FIG. 4C. The layer of insulating material 414 is secured to the shell inner surface 410 using a securing technique known to the skilled addressee such as gluing or the like. The layer of thermally insulating material 414 advantageously contributes to insulate the shell outer surface 412 from the container 102 when the container 102 is received in the shell 104. Therefore, when the container 102 is at the refrigerating temperature and is received in the shell 104, the layer of insulating material 414 contributes to maintaining the outer shell surface 412 at the ambient temperature.

In one embodiment, the refrigerant assembly 100 is placed in an environment containing a given amount of humidity. The skilled addressee will appreciate that condensation tends to form on a given surface at a temperature lower than an ambient temperature when the given surface is placed in such an environment. Therefore, the layer of thermally insulating material 414 further contributes to preventing formation of condensation on the shell outer surface 412 when the container 102 is at the refrigerating temperature and is received in the shell 104.

Figure 5A:
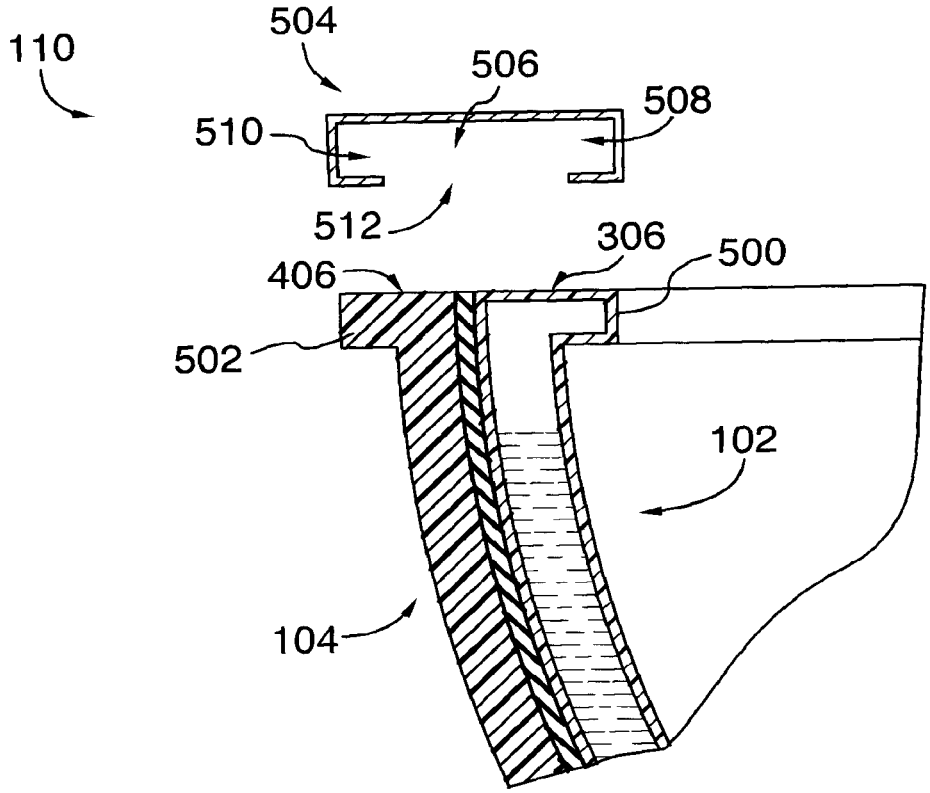
FIG. 5A is a drawing showing an enlarged and partly exploded sectional view, taken along line V-V of FIG. 1, of the refrigerating assembly shown in FIG. 1, in accordance with one embodiment, with the fastening ring disengaged from the container and the shell.
Figure 5B:
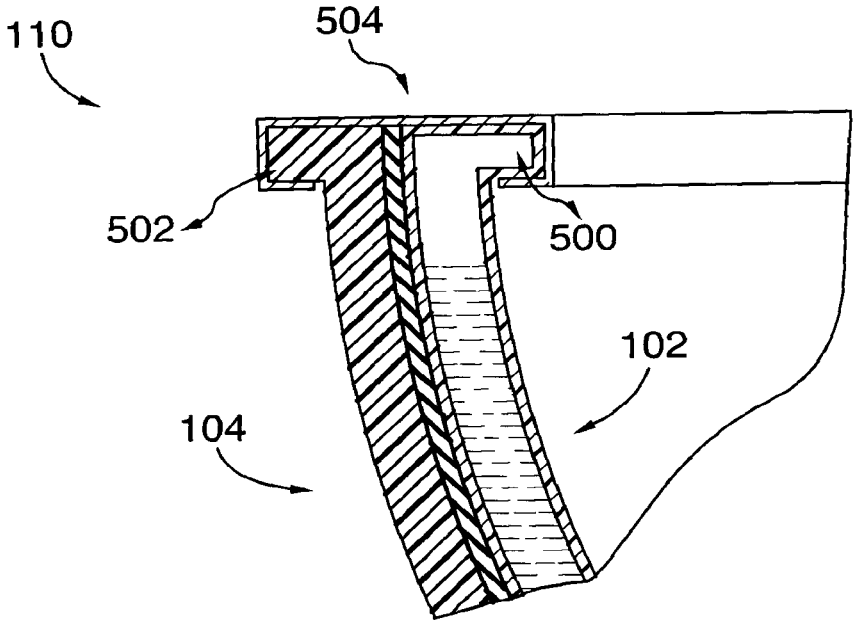
FIG. 5B is a drawing showing an enlarged sectional view, taken along line V-V of FIG. 1, of the refrigerating assembly shown in FIG. 5A, with the fastening ring engaging the container and the shell.

Now turning to FIGS. 5A and 5B, there are shown attachment means 110 for attaching the container 102 to the shell 104, in accordance with one embodiment.

In this embodiment, the attachment means 110 comprise a first peripheral flange 500 extending inwardly from the rim 306 of the container 102, an opposed second peripheral flange 502 extending outwardly from the rim 406 of the shell 104 and a fastening element 550 for engaging the first and second annular protrusions 500, 502 to thereby removably attach the container 102 to the shell 104.

In the illustrated embodiment, the fastening element 550 comprises a fastening ring 504 having an annular channel 506 defined therein. The annular channel 506 has a first channel portion 508 adapted to receive the first peripheral flange 500 and an opposed second channel portion 510 adapted to receive the second peripheral flange 502. The first and second peripheral flanges 500, 502 are inserted in the annular channel 506 through a bottom annular opening 512 of the fastening ring 504.

It will be appreciated by the skilled addressee that the fastening ring 504 is made from a resilient material for engaging the first and second peripheral flanges 500, 502 in snap engagement, as best shown in FIG. 5B. In one embodiment, the resilient material is a thermoplastic selected from a group consisting of acrylonitrile butadiene styrene, or ABS, and polyvinyl chloride, or PVC. This allows the fastening ring 504 to be manufactured relatively unexpensively while reducing the weight of the fastening ring 504, which is of great advantage when the refrigerating assembly 100 is transported.

In the illustrated embodiment, each of the first and second peripheral flanges 500, 502 has a generally square cross-section and each of the first and second channel portions 508 and 510 has a corresponding generally square cross-section.

Figure 6A:
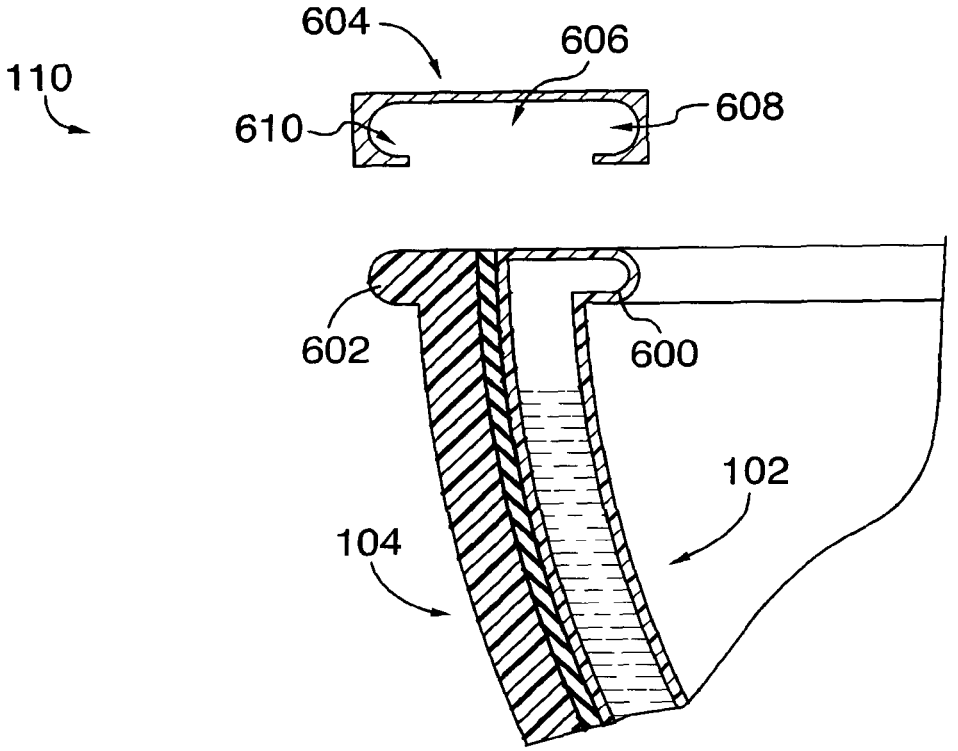
FIG. 6A is a drawing showing an enlarged and partly exploded sectional view, taken along line V-V of FIG. 1, of the refrigerating assembly shown in FIG. 1, in accordance with an alternative embodiment, with the fastening ring disengaged from the container and the shell.
Figure 6B:
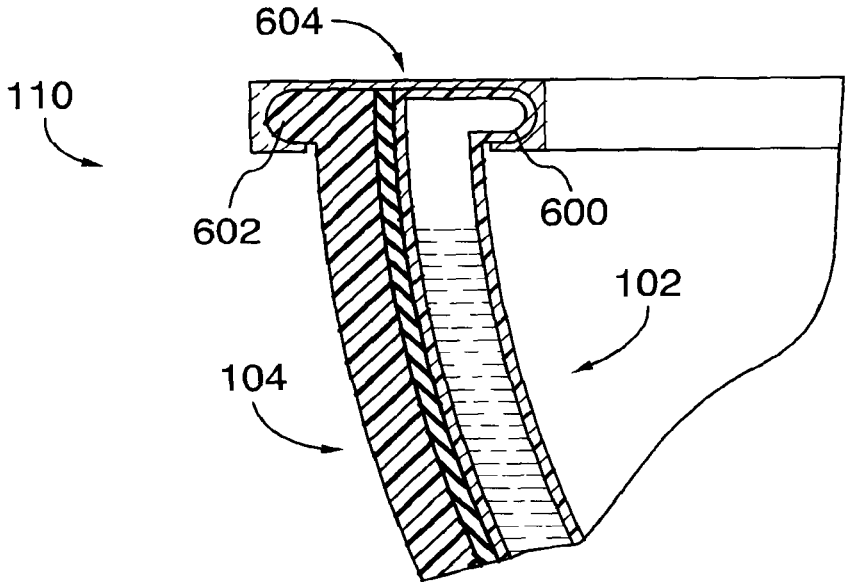
FIG. 6B is a drawing showing an enlarged sectional view, taken along line V-V of FIG. 1, of the refrigerating assembly shown in FIG. 6A, with the fastening ring engaging the container and the shell.

Now turning to FIGS. 6A and 6B, there is shown attachment means 110 for removably attaching the container 102 to the shell 104, in accordance with an alternative embodiment.

Similarly to the embodiment shown in FIGS. 5A and 5B, the attachment means 110 comprise a first and second peripheral flanges 600, 602, and a fastening ring 604 having an annular channel 606 defined therein, the annular channel 606 having a first and second channel portion 608, 610 respectively adapted to receive the first and second peripheral flanges 600, 602.

In this embodiment, each of the first and second peripheral flanges 600, 602 has a generally semicircular cross-section and each of the first and second channel portions 608, 610 has a corresponding generally semicircular cross-section. This configuration advantageously facilitates insertion of the first and second peripheral flanges 600, 602 in the annular channel 606, as one skilled in the art will appreciate.

Figure 7A:
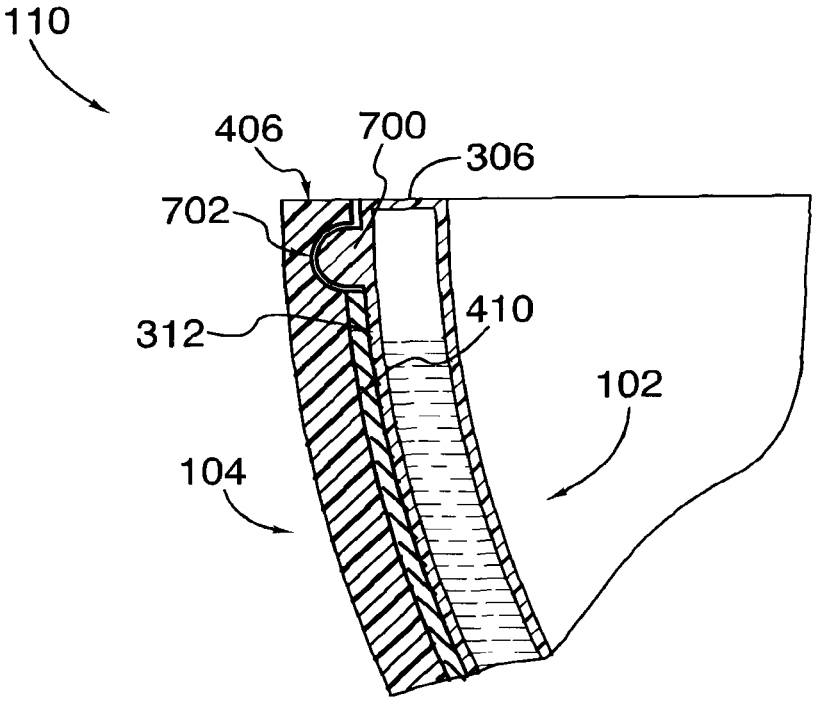
FIG. 7A is a drawing showing an enlarged sectional view, taken along line V-V of FIG. 1, of the refrigerating assembly shown in FIG. 1, in accordance with another embodiment.
Figure 7B:
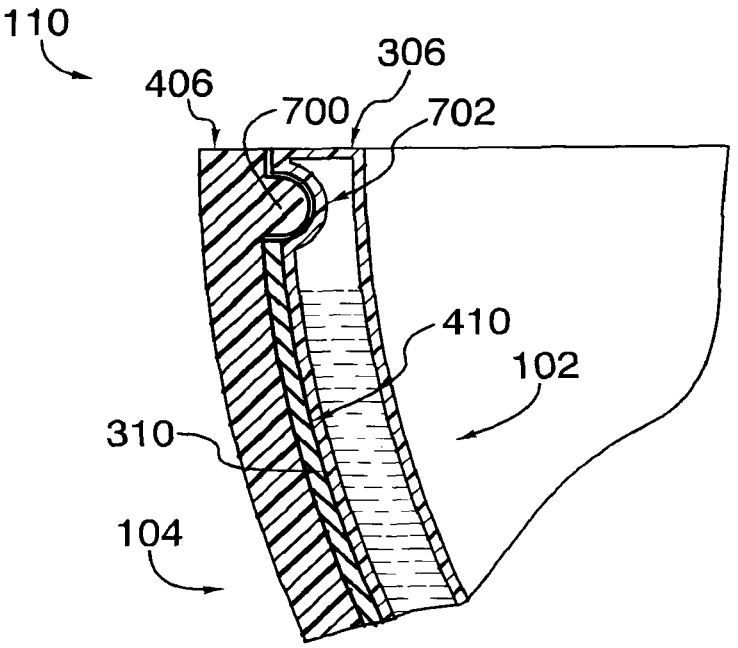
FIG. 7B is a drawing showing an enlarged sectional view, taken along line V-V of FIG. 1, of the refrigerating assembly shown in FIG. 1, in accordance with yet another embodiment.

Now turning to FIGS. 7A and 7B, there is shown attachment means 110 for removably attaching the container 102 to the shell 104, in accordance with yet another embodiment. In this embodiment, the attachment means 110 comprise an annular protrusion 700 and a corresponding annular groove 702, the annular protrusion 700 and a corresponding annular groove 702 being respectively associated with one of the container 102 and the shell 104.

For instance, according to the configuration shown in FIG. 7A, the annular protrusion 700 extends outwardly from the container outer surface 312, near the rim 306 of the container 102, and the corresponding annular groove 702 is defined in the shell inner surface 410, near the rim 406 of the shell 104.

In the configuration shown in FIG. 7B, the annular protrusion 700 extends inwardly from the shell inner surface 410, near the rim 406 of the shell 104, and the corresponding annular groove 702 is defined in the container outer surface 312, near the rim 306 of the container 102.

In both configurations, the container 102 and/or the shell 104 is made of a resilient material to enable the annular protrusion 700 to engage the corresponding annular groove 702 when the container 102 is received in the shell 104, thereby removably attaching the container to the shell, as one skilled in the art will appreciate. In one embodiment, the resilient material is a thermoplastic selected from a group consisting of acrylonitrile butadiene styrene, or ABS, and polyvinyl chloride, or PVC. This allows the container 102 and/or the shell 104 to be manufactured relatively unexpensively while reducing the weight of the container 102 and/or the shell 104, which is of great advantage when the refrigerating assembly 100 is transported.

Figure 8:
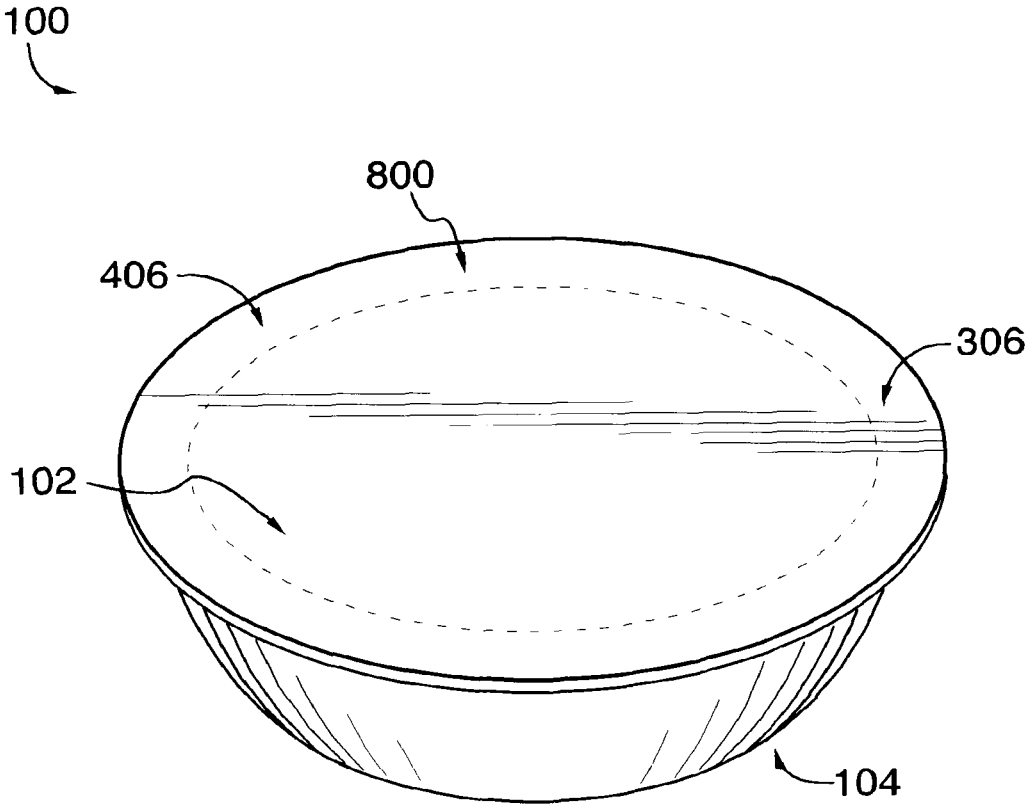
FIG. 8 is a drawing showing a perspective view of the refrigerating assembly shown in FIG. 1, with a cover fastened on the shell.

Now turning to FIG. 8, there is shown attachment means for removably attaching the container 102 to the shell 104, in accordance with yet another embodiment. In this embodiment, the attachment means 110 comprise a cover 800 adapted to be fastened on the rim 406 of the shell 104 and to abut the rim 306 of the container 102 to prevent the container 102 from exiting the shell 104 through the opening 408 of the shell 104, as one skilled in the art will appreciate.

It will be appreciated that various other embodiments may be provided for the attachment means 110, as long as it enables the container 102 to be removably attached to the shell 104 when the container 102 is received in the shell 104.

Figure 9:
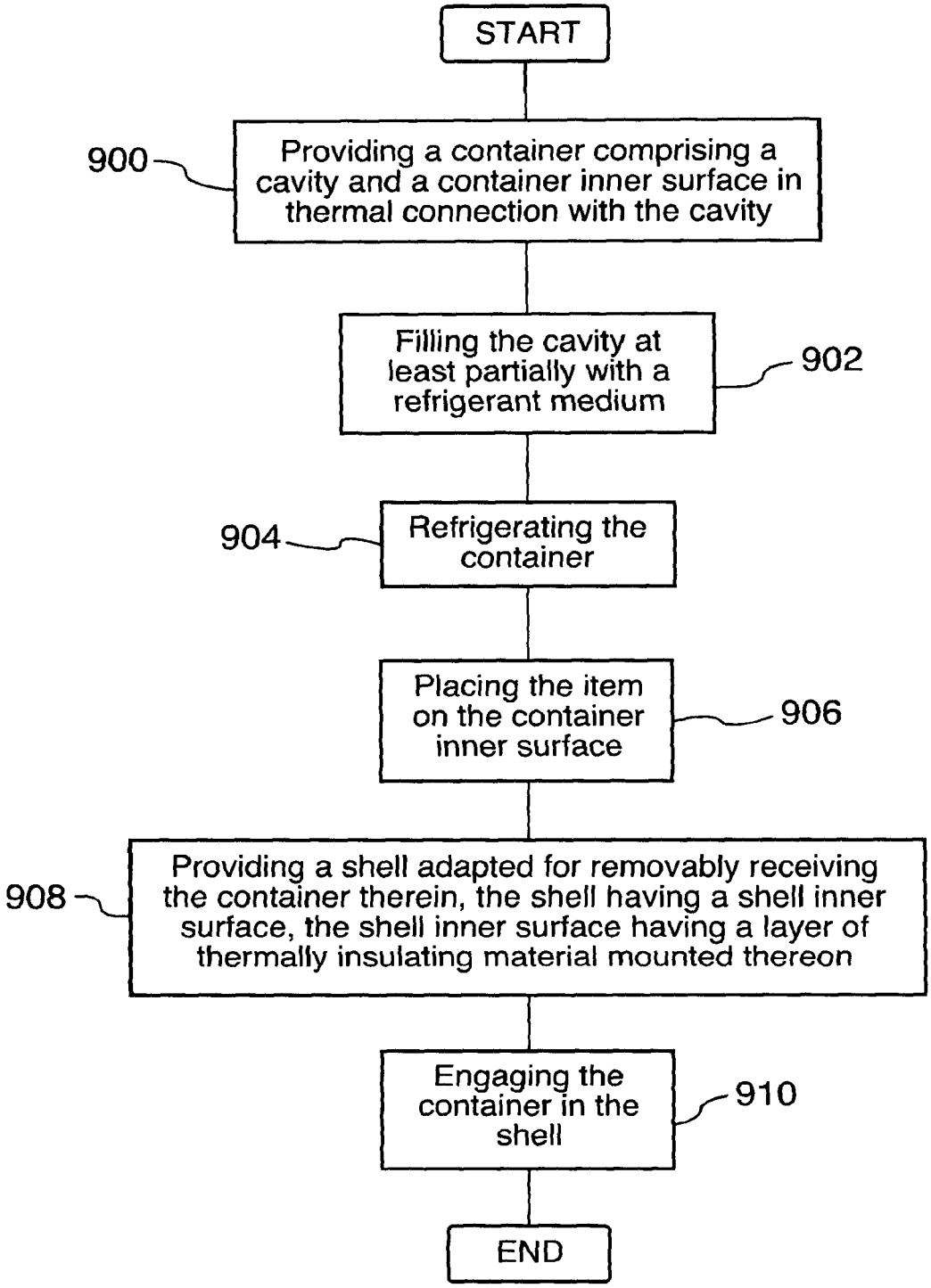
FIG. 9 is a flowchart showing a method for temporarily storing an item at a first temperature lower than an ambient temperature, in accordance with one embodiment.

Having described the components of the refrigerating assembly 100, a method for refrigerating an item will now be detailed, in accordance with one embodiment and with references to FIG. 9.

According to step 900, the container 102 of the refrigerant assembly 100 as hereabove described is first provided.

According to step 902, the cavity 314 is at least partially filled with the refrigerant medium 350.

According to step 904, the container 102 is then placed in a cooling environment such as a refrigerator. This operation enables the refrigerant medium 350 contained in the cavity 314 of the container 102 to reach the refrigerating temperature.

The skilled addressee will appreciate that two bodies having different temperatures will tend towards thermal equilibrium when put in thermal connection with each other. Therefore, an item at a first given temperature, when put in thermal connection with a body at a second given temperature, will reach a third given temperature located between the first and second given temperatures.

In one embodiment, the refrigerating temperature is lower than the desired storage temperature. For instance, if the item 150 is originally at an ambient temperature of about 25 degrees Celsius and the desired storage temperature of the item 150 is about 5 degrees Celsius, the refrigerating temperature reached by the refrigerant medium 350 is slightly lower than 5 degrees Celsius.

According to step 906, once the refrigerant medium 350 has reached the refrigerating temperature, the item 150 is placed on the container inner surface 310. The container inner surface 310 being in thermal connection with the cavity 314, the temperature of the item 150 is shifted towards the desired storage temperature, as one skilled in the art will appreciate.

Alternatively, the item 150 may be placed on the container inner surface 310 prior to the container 102 being refrigerated. In such an embodiment, the refrigerating temperature is about the same as the desired storage temperature. For instance, if the item 150 is originally at the ambient temperature of about 25 degrees Celsius and the desired storage temperature of the item 150 is about 5 degrees Celsius, the refrigerating temperature reached by the refrigerating medium 350 is about 5 degrees Celsius.

The skilled addressee will appreciate that the temperatures herein specified are merely provided as examples and that any value of temperature may be selected for the ambient temperature, the desired storage temperature and the refrigerating temperature, as long as the desired storage temperature and the refrigerating temperature are both lower than the ambient temperature.

Once the item 150 is placed on the container inner surface 310 and the refrigerant medium 350 is at the refrigerating temperature, the item 150 is temporarily maintained at or around the desired storage temperature.

According to step 908, the shell 104 of the refrigerant assembly 100 as hereabove described is then provided.

According to step 910, the container 102 is then engaged in the shell 104, the container outer surface 312 resting on the layer of insulating material 414 mounted on the shell inner surface 410. The formation of condensation is prevented by the thermal insulation provided by the layer of thermally insulating material 414, the shell outer surface 412 thereby remaining dry. This is of great advantage for storing the refrigerating assembly 100 in the proximity of other objects, such as in a lunchbox containing other food products, a purse containing one or more personal articles or a schoolbag containing books and other paper products, without wetting the other products or articles when they come in contact with the shell outer surface 412.

It will be appreciated that when the refrigerant medium 350 is at the refrigerating temperature and the refrigerating assembly 100 is placed in an environment at the ambient temperature, the refrigerant medium 350 may tend to shift towards the ambient temperature. In this case, heat may be transmitted from the environment into the cavity 314 through the container inner surface 310 and the container outer surface 312.

In the illustrated embodiment, the layer of insulating material 414 contributes to insulate the container 102 from the environment when the container 102 is received in the shell 104. More specifically, the layer of insulating material 414 substantially decreases transmission of heat through the container outer surface 312, from the environment to the cavity 314. It will be appreciated that the refrigerant medium 350 at the refrigerating temperature may therefore advantageously remain at the refrigerant temperature and maintain the item 150 at the desired storage temperature for a longer period of time than if the refrigerating assembly 100 did not comprise the shell 104 and the layer of insulating material 414 and that the container outer surface 312 was resting directly on the shell inner surface 410 or was directly exposed to the environment.

Moreover, if the refrigerating assembly 100 is used for a commercial application, such as in a hotel or a restaurant, the shell 104 advantageously preserves the aesthetic appearance of the container 102 by preventing the formation of condensation on the shell outer surface 412, which may detract from the aesthetic appearance of the refrigerating assembly 100 by partially or completely hiding logos or other graphics printed or inscribed thereon.

In such an embodiment, the refrigerating assembly 100 may further be provided with a plurality of interchangeable shells. This advantageously enables a user of the refrigerant assembly 100 such as a restaurant manager to modify the external appearance of the refrigerant assembly 100 without changing the container 102. According to this configuration, a first shell may be interchanged with a second shell even while the item 150 is received in the container 102 and maintained at the desired storage temperature.

It is also widely known that containers used for a commercial application, such as in a hotel or a restaurant, may be manufactured from a metal, such as stainless steel, to provide a relatively elegant appearance to the containers. Therefore, in one embodiment, the shell 104 is manufactured from a metal, such as stainless steel, to provide a relatively elegant appearance to the refrigerating assembly 100. This further advantageously enables a hotel or restaurant manager to maintain the relatively elegant appearance of a set of containers which comprises one or more refrigerating assembly 100 as described herein and other regular containers.

Although the above description relates to a specific preferred embodiment as presently contemplated by the inventor, it will be understood that the invention in its broad aspect includes mechanical and functional equivalents of the elements described herein.

The invention claimed is:

1. A refrigerating assembly, comprising:

a container comprising a container sidewall having a container inner surface for receiving an item thereon and a container outer surface, the container sidewall defining a cavity enclosed by the container sidewall, the cavity containing an amount of a refrigerant medium having a second temperature lower than an ambient temperature, the cavity being in thermal connection with the container inner surface for temporarily maintaining the item at a first temperature when the item is received on the container inner surface, the container sidewall further having a closed end and an open end defining an opening for selectively placing the item in the container and removing the item from the container, the open end having a peripheral edge defining a rim of the container, the closed end having an entirely closed flat bottom configured to support the item via the flat bottom of the container;

a shell comprising a shell sidewall having a shell inner surface and a shell outer surface, the shell outer surface being at the ambient temperature, the shell inner surface having a layer of thermally insulating material mounted thereon for thermally insulating the shell from the container when the container is removably received in the shell, thereby maintaining the shell outer surface at the ambient temperature when the container is received in the shell, the shell sidewall further having a closed end and an open end defining an opening for selectively placing the container in the shell and removing the container from the shell, the open end having a peripheral edge defining a rim of the shell, wherein the container is removably received in the shell; and attachment means for removably attaching the container to the shell when the container is received in the shell, the attachment means comprising an annular protrusion and a corresponding annular groove, the annular protrusion and the corresponding annular groove being respectively associated with one of the container and the shell.

2. The refrigerating assembly as claimed in claim 1, wherein the annular groove is defined in the shell inner surface, near the rim of the shell, and the corresponding annular protrusion extends outwardly from the container outer surface, near the rim of the container, for removably engaging the annular groove.

3. The refrigerating assembly as claimed in claim 1, wherein the annular groove is defined in the container outer surface, near the rim of the container, and the corresponding annular protrusion extending inwardly from the shell inner surface, near the rim of the shell, for removably engaging the annular groove.

4. The refrigerating assembly as claimed in claim 2, wherein at least one of the container and the shell is manufactured from a resilient material to enable the annular protrusion to engage the corresponding annular groove in a snap engagement when the container is received in the shell.

5. The refrigerating assembly as claimed in claim 4, wherein the resilient material is a thermoplastic selected from a group consisting of acrylonitrile butadiene styrene and polyvinyl chloride.

6. The refrigerating assembly as claimed in claim 1, wherein the shell is adapted to cover at least part of the container outer surface when the container is received in the shell.

7. The refrigerating assembly as claimed in claim 1, wherein the container comprises a flat bottom portion for enabling the container to rest on a flat surface while keeping the opening of the container facing upwardly.

8. The refrigerating assembly as claimed in claim 1, wherein the container sidewall comprises a relief opening defined on one of the container inner surface and the container outer surface for allowing communication between the cavity and the environment such that pressure inside the cavity is maintained equal to an ambient pressure.

9. The refrigerating assembly as claimed in claim 1, wherein the container and the shell are complementary in shape for enabling the container outer surface to rest against the layer of thermally insulating material.

10. The refrigerating assembly as claimed in claim 1, wherein the refrigerant medium comprises a refrigerant gel.

* * * * *